US011839009B2

(12) United States Patent
Yoshida et al.

(10) Patent No.: US 11,839,009 B2
(45) Date of Patent: Dec. 5, 2023

(54) PORTABLE INDUCTION HEATING DEVICE FOR COATING REMOVAL

(71) Applicant: DAI-ICHI HIGH FREQUENCY CO., LTD., Tokyo (JP)

(72) Inventors: Hirotaka Yoshida, Tokyo (JP); Tetsunori Nakamura, Tokyo (JP); Yoshimasa Hiramatsu, Tokyo (JP)

(73) Assignee: DAI-ICHI HIGH FREQUENCY CO., LTD., Tokyo (JP)

( * ) Notice: Subject to any disclaimer, the term of this patent is extended or adjusted under 35 U.S.C. 154(b) by 455 days.

(21) Appl. No.: 16/334,620

(22) PCT Filed: Sep. 27, 2016

(86) PCT No.: PCT/JP2016/078488
§ 371 (c)(1),
(2) Date: Mar. 19, 2019

(87) PCT Pub. No.: WO2018/061091
PCT Pub. Date: Apr. 5, 2018

(65) Prior Publication Data
US 2021/0307125 A1 Sep. 30, 2021

(51) Int. Cl.
*H05B 6/10* (2006.01)
*H01F 38/14* (2006.01)
(Continued)

(52) U.S. Cl.
CPC ..... *H05B 6/10* (2013.01); *H01F 38/14* (2013.01); *H05B 1/0294* (2013.01); *H05B 6/06* (2013.01);
(Continued)

(58) Field of Classification Search
None
See application file for complete search history.

(56) References Cited

U.S. PATENT DOCUMENTS 5,660,753 A * 8/1997 Lingnau ..... B08B 7/0071 134/17
6,509,555 B1 * 1/2003 Riess ..... B23K 13/01 219/663
(Continued)

FOREIGN PATENT DOCUMENTS

EP 2790880 B1 * 9/2015 ..... B26F 3/06
JP 8-131563 A 5/1996
(Continued)

OTHER PUBLICATIONS http://web.archive.org/web/20161121200523/https://www.electronics-tutorials.ws/inductor/inductance.html (Year: 2016).*
(Continued)

*Primary Examiner* — William J Levicky
*Assistant Examiner* — Adam M Eckardt
(74) *Attorney, Agent, or Firm* — IP BUSINESS SOLUTIONS, LLC

(57) ABSTRACT

A heater for coating removal heating a metal member having a surface coated with a coating film, includes a high-frequency power source; a transformer transforming a high-frequency current outputted from the high-frequency power source; and a plurality of heating units, each heating unit being detachably connectable to the transformer to heat the metal member disposed in contact with or near the heater for coating removal by the high-frequency current outputted from the transformer. One heating unit is selected from the plurality of heating units and attached to the transformer. The inductance value of the plurality of heating units except for the selected heating unit is adjusted to be within a predetermined range relative to the inductance value of the selected heating unit.

5 Claims, 8 Drawing Sheets

(51) Int. Cl.

| | |
|---|---|
| ***H05B 1/02*** | (2006.01) |
| ***H05B 6/06*** | (2006.01) |
| ***H05B 6/14*** | (2006.01) |
| ***H05B 6/44*** | (2006.01) |

(52) U.S. Cl.
CPC ..... *H05B 6/145* (2013.01); *H05B 6/44* (2013.01); *H05B 2206/022* (2013.01); *H05B 2206/024* (2013.01)

(56) References Cited

U.S. PATENT DOCUMENTS

| | | | | |
|---|---|---|---|---|
| 6,875,966 | B1 * | 4/2005 | Barber | B23K 3/04 219/616 |
| 6,911,089 | B2 * | 6/2005 | Latvis | B05C 9/14 118/712 |
| 10,462,853 | B2 * | 10/2019 | Fanetti | B23K 9/235 |
| 2004/0084443 | A1 * | 5/2004 | Ulrich | H05B 6/36 219/672 |
| 2004/0188424 | A1 * | 9/2004 | Thomas | H05B 6/14 219/632 |
| 2008/0092919 | A1 * | 4/2008 | Baann | H05B 6/101 134/1 |
| 2012/0248093 | A1 * | 10/2012 | Ulrich | H05B 6/14 219/600 |
| 2014/0231415 | A1 * | 8/2014 | Verhagen | H05B 6/14 219/660 |
| 2014/0285607 | A1 * | 9/2014 | Taniguchi | B41J 2/3351 347/208 |

FOREIGN PATENT DOCUMENTS

| | | | |
|---|---|---|---|
| JP | 3359382 | B | 12/2002 |
| JP | 2014-162110 | A | 9/2014 |
| JP | 2016-110752 | A | 6/2016 |

OTHER PUBLICATIONS http://web.archive.org/web/20140310040458/https://www.uihm.com/en/Induction-Heating-Technology/Base-details-of-High-Frequency-Induction-Heating.html#.Ux06BXbP1aQ (Year: 2014).*
http://web.archive.org/web/20160327122523/https://www.millerwelds.com/products/induction-heating-systems (Year: 2016).*

* cited by examiner

PORTABLE INDUCTION HEATING DEVICE FOR COATING REMOVAL

TECHNICAL FIELD

The present invention relates to a heater for coating removal, specifically a heater for coating removal by induction heating.

BACKGROUND ART

Metal surfaces of steel bridges, marine vessels, tanks, and other structures are coated with paint. Such paint coating should be removed before construction, such as maintenance or repair. Such coating, however, is difficult to remove because it is bonded to the metal surface with an adhesive. For example, mechanical removal causes noise and requires heavy labor. Combustive removal has problems in that the high temperatures cause deterioration of the metal and generation of toxic gases.

In view of such circumstances, paint is removed from the metal members through the use of electromagnetic induction heating, as described in Patent Documents 1 and 2. In such a scheme, a heating head 130 is disposed in contact with a metal member 150, such as a steel plate, having a surface coated with a coating film 151 and moved in the direction indicated by the arrow in FIG. 1. Through high-frequency induction heating, the metal member 150 underneath the coating film is heated to temperatures, for example, within the range of 150 to 200 degrees, to lower the adhesive force causing the coating film 151 to adhere to the metal member 150. In such a state, the coating film 151 is removed from the metal member 150 with a tool, such as a scraper 140. In this way, the coating film 151 can be readily removed.

An example of a technique used during electromagnetic induction heating is the apparatus disclosed in Patent Document 3. Patent Document 3 describes a technique of connecting a heating head including a heating coil to a transformer via a cable having a predetermined length.

Patent Document 1: Japanese Patent Publication No. 3359382

Patent Document 2: Japanese Unexamined Patent Application Publication No. 2014-162110

Patent Document 3: U.S. Pat. No. 5,660,753

SUMMARY

The apparatus disclosed in Patent Document 1 is provided with a heating unit or electromagnetic induction unit (20) disposed on a coupling arm (40) extending from an apparatus body (10). Thus, to move the heating unit of such an apparatus to a target area of coating removal, the entire apparatus body (10) has to be moved. The apparatus body (10), which includes a power source and a transformer, is heavy and thus difficult to move. This causes a problem in that the coating film cannot be smoothly removed from small parts.

The apparatus disclosed in Patent Document 2 includes a power generator (58), a main induction unit (51), and a heating unit or induction head unit (56), all connected with each other via a cable (52). In the apparatus, a connector box (55) having an in-bedded amplifying transformer is disposed on the cable (52), specifically near the induction head unit (56). The heavy amplifying transformer disposed near the induction head unit (56) hinders the movement of the induction head unit (56). This causes a problem in that the coating cannot be smoothly removed from small parts.

As described above, the apparatuses disclosed in Patent Document 1 and 2 have a problem in that the coating cannot be smoothly removed from small parts.

The apparatus disclosed in Patent Document 3 includes a small heating head (20). Thus, there is a problem in the apparatus is unsuitable for removal of coating from a large area.

In the case of the apparatuses disclosed in Patent Document 1 and 2, it is difficult to smoothly remove the coating film from small parts. In contrast, in the case of the apparatus disclosed in Patent Document 3, there is a problem in that it is difficult to remove coating from a large area. Thus, it is desirable that the apparatuses disclosed in Patent Documents 1 and 2 be compatible with the apparatus disclosed in Patent Document 3 such that one of the apparatuses can be selected in accordance with its intended use. Unfortunately, a difference in the sizes of heating heads leads to a difference in the number of turns of the heating coils used in the heating heads. As a result, the number of turns of the transformer should be varied (or, for example, the transformer should be replaced with a different one) or the capacitance of the matching capacitor should be varied in accordance with the heating head to be used. This is a problem that requires significant time and effort.

An object of the present invention is to provide a heater for coating removal that can solve the above-described problem of the need of replacing the transformer, which is a process that requires significant time and effort, when the heating head to be used is selected among multiple heating heads.

A heater for coating removal according to an aspect of the present invention heating a metal member having surface coated with a coating film, includes a high-frequency power source; a transformer transforming a high-frequency current outputted from the high-frequency power source; and a plurality of heating units detachably connectable to the transformer to heat the metal member disposed in contact with or near the heater by the high-frequency current outputted from the transformer. One heating unit is selected from the plurality of heating units and attached to the transformer, and an inductance value of the plurality of heating units except for the one heating unit selected from the plurality of heating units is adjusted to fall within a predetermined range relative to an inductance value of the heating unit selected from the plurality of heating units.

The heater for coating removal, wherein, at least one heating unit among the plurality of heating units may include a cable sending a high-frequency current transformed at the transformer; and a cable-connected heating head including a heating coil connected to an end of the cable and heating the metal member disposed in contact with or near the heater for coating removal by the high-frequency current, and the sum of an inductance value of the heating coil of the cable-connected heating head and an inductance value of the cable may be adjusted to be within a predetermined range relative to an inductance value of the at least one heating unit among the plurality of heating units.

The heater for coating removal, wherein, at least one heating unit among the plurality of heating units may include an integrated heating head integrated with the transformer and including a heating coil heating the metal member disposed in contact with or near the heater for coating removal by the high-frequency current, and an inductance value of the plurality of heating units except for the at least one heating unit may be adjusted to be within a predetermined range relative to an inductance value of the at least heating among the plurality of heating units.

The heater for coating removal, wherein, the cable may connect the transformer and the heating coil of the cable-connected heating head, and the length of the cable may be adjusted in accordance with the inductance value of the heating coil of the cable-connected heating head such that the sum of the inductance value of the heating coil of the cable-connected heating head and the inductance value of the cable is within a predetermined range relative to the inductance value of one heating unit among the plurality of heating units.

The heater for coating removal, wherein the cable may include one water-cooling coaxial cable.

The heater for coating removal, wherein, the plurality of heating units may include a first heating unit including a cable sending a high-frequency current transformed at the transformer; and a first heating head including a first heating coil connected to an end of the cable and heating the metal member disposed in contact with or near the heater for coating removal by the high-frequency current; and a second heating unit including a second heating head integrated with the transformer and including a second heating coil heating the metal member disposed in contact with or near the heater for coating removal by the high-frequency current. The sum of an inductance value of the cable of the first heating unit and an inductance value of the first heating coil may be adjusted to be within a predetermined range relative to an inductance value of the second heating coil.

The heater for coating removal wherein when the inductance value of the second heating coil is 1.0, the sum of the inductance value of the cable of the first heating coil and the inductance value of the first heating coil may be adjusted to be within a range of 0.6 to 1.3.

The present invention having the above-described configuration requires no replacement of the transformer in accordance with the heating head selected for use among multiple heating heads, and thus the multiple heating heads can be selectively used without excess time and effort.

EXEMPLARY EMBODIMENTS

First Exemplary Embodiment

Figure 1:
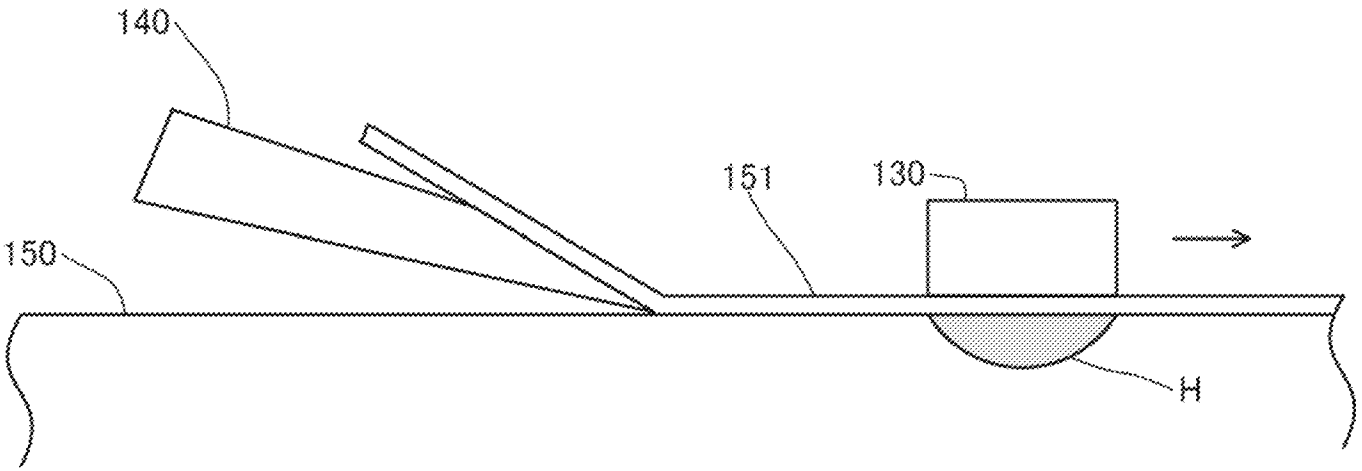
FIG. 1 illustrates the operation of coating removal.
Figure 2:
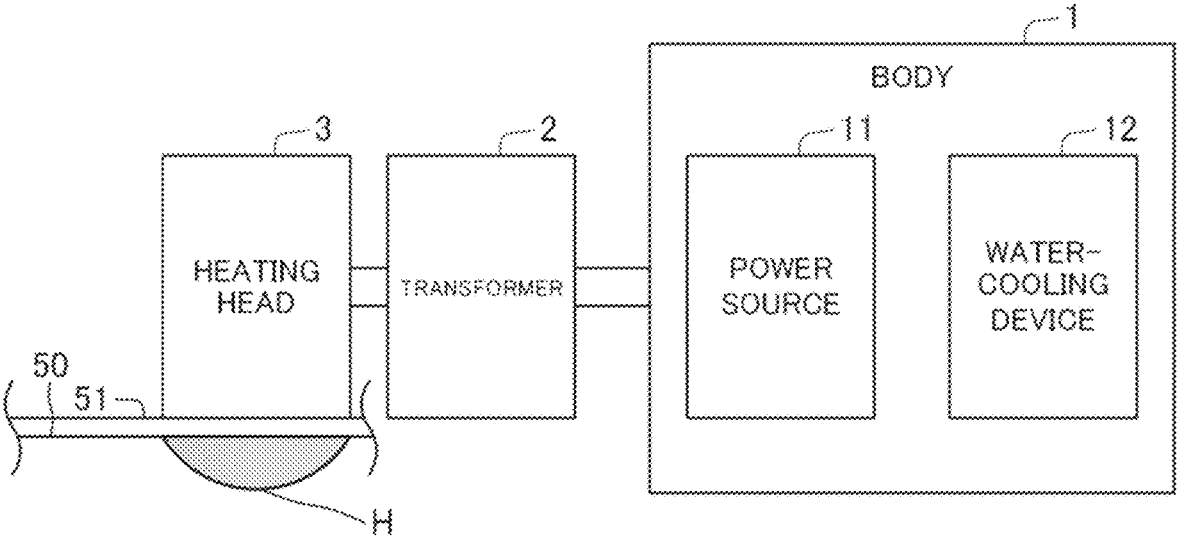
FIG. 2 illustrates the overall configuration of a heater for coating removal according to the present invention.
Figure 3:
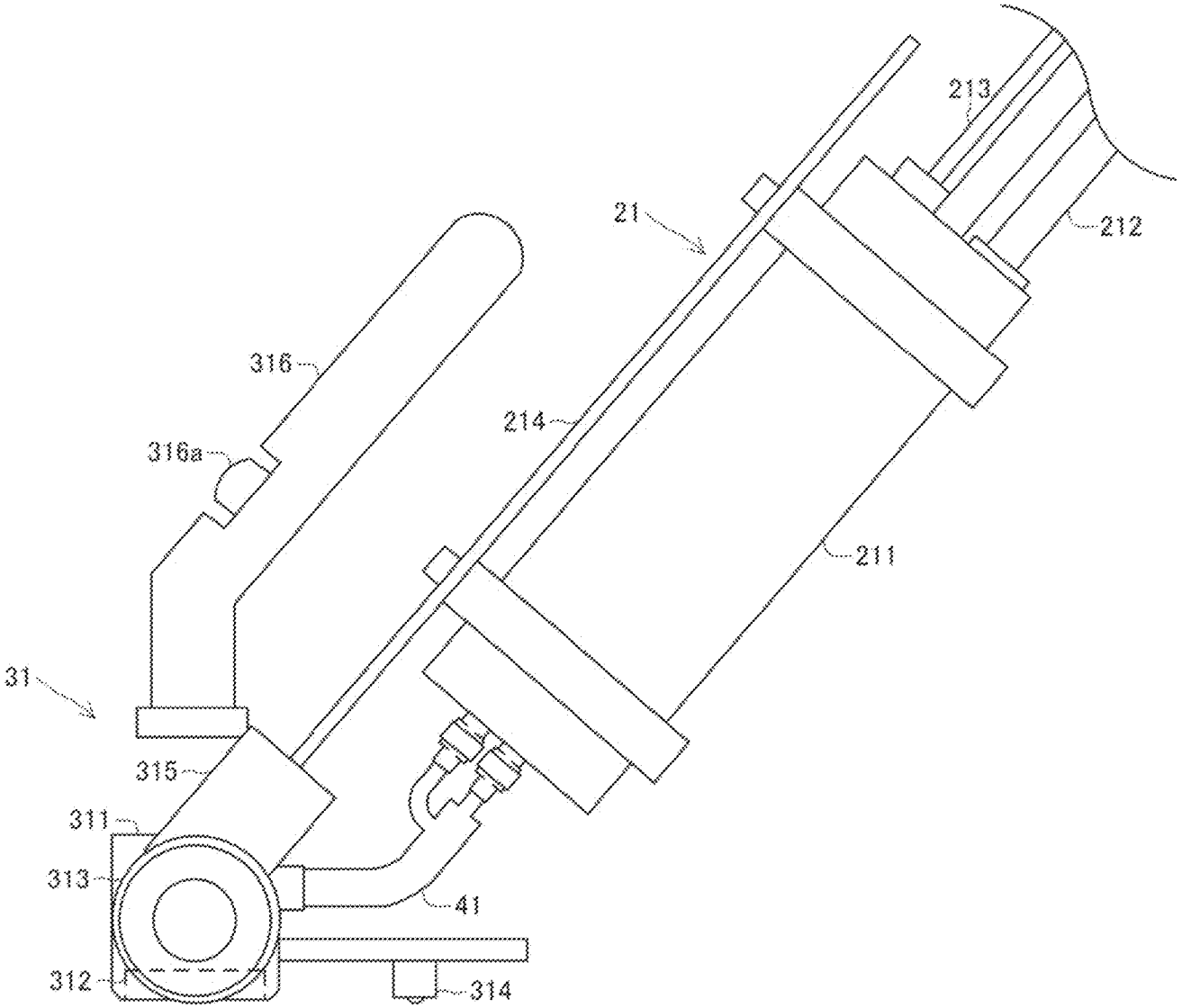
FIG. 3 illustrates an example configuration of the transformer and the heating head illustrated in FIG. 2.
Figure 4:
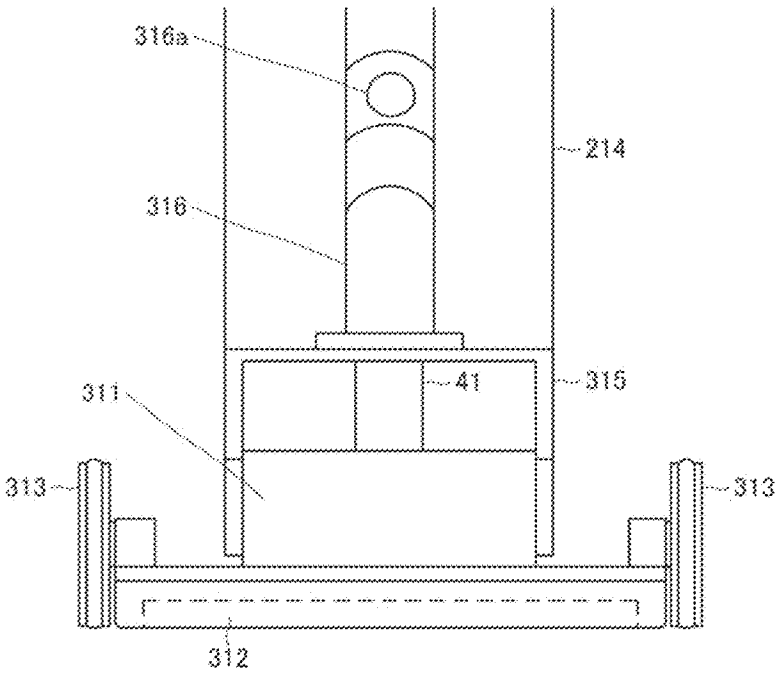
FIG. 4 illustrates an example configuration of the heating head illustrated in FIG. 3.
Figure 5:
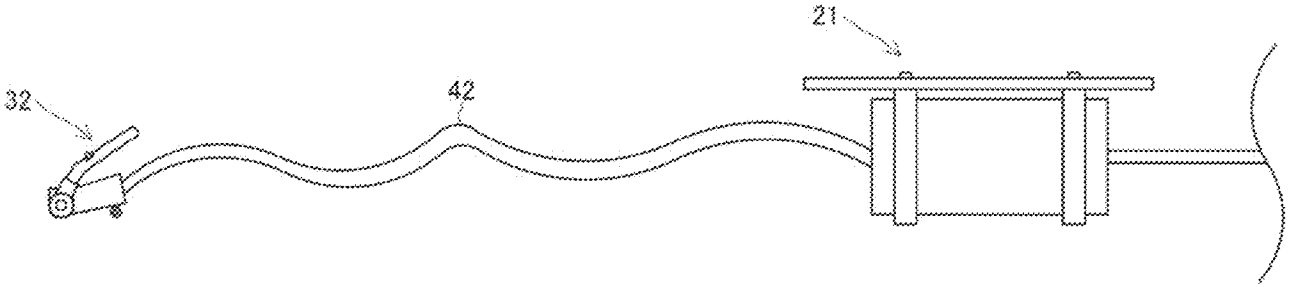
FIG. 5 illustrates another example configuration of the transformer and the heating head illustrated in FIG. 2.
Figure 6:
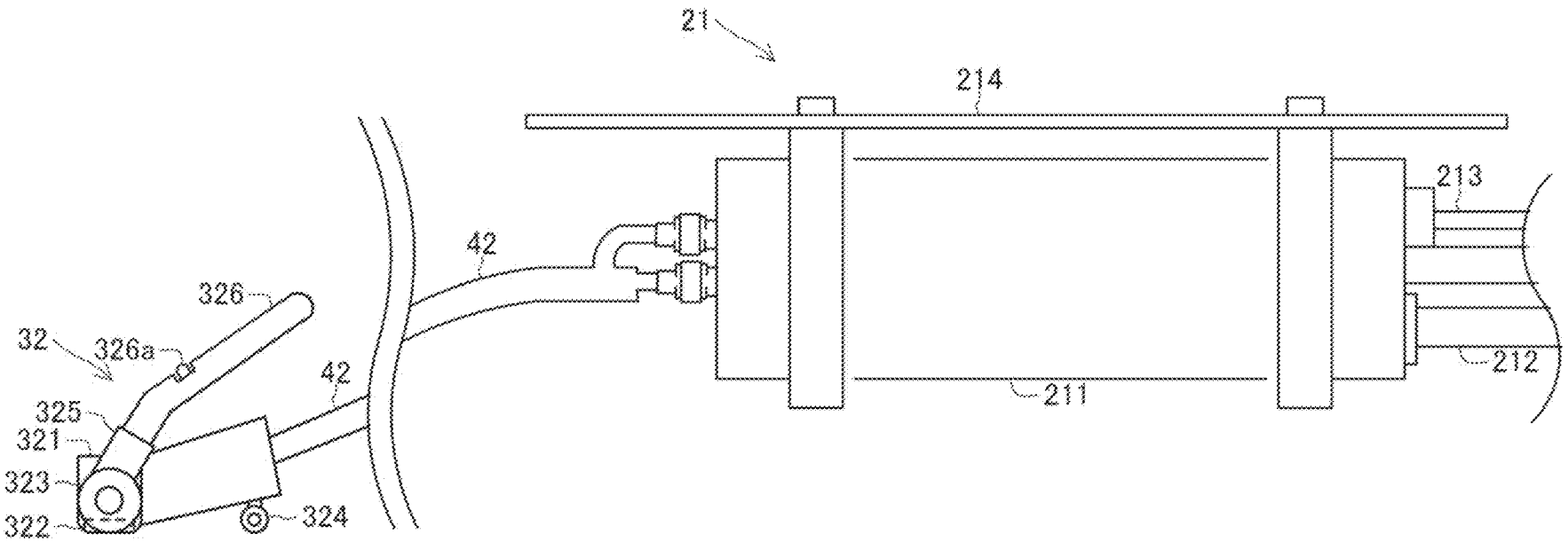
FIG. 6 illustrates an example configuration of the transformer and the heating head illustrated in FIG. 5.
Figure 7:
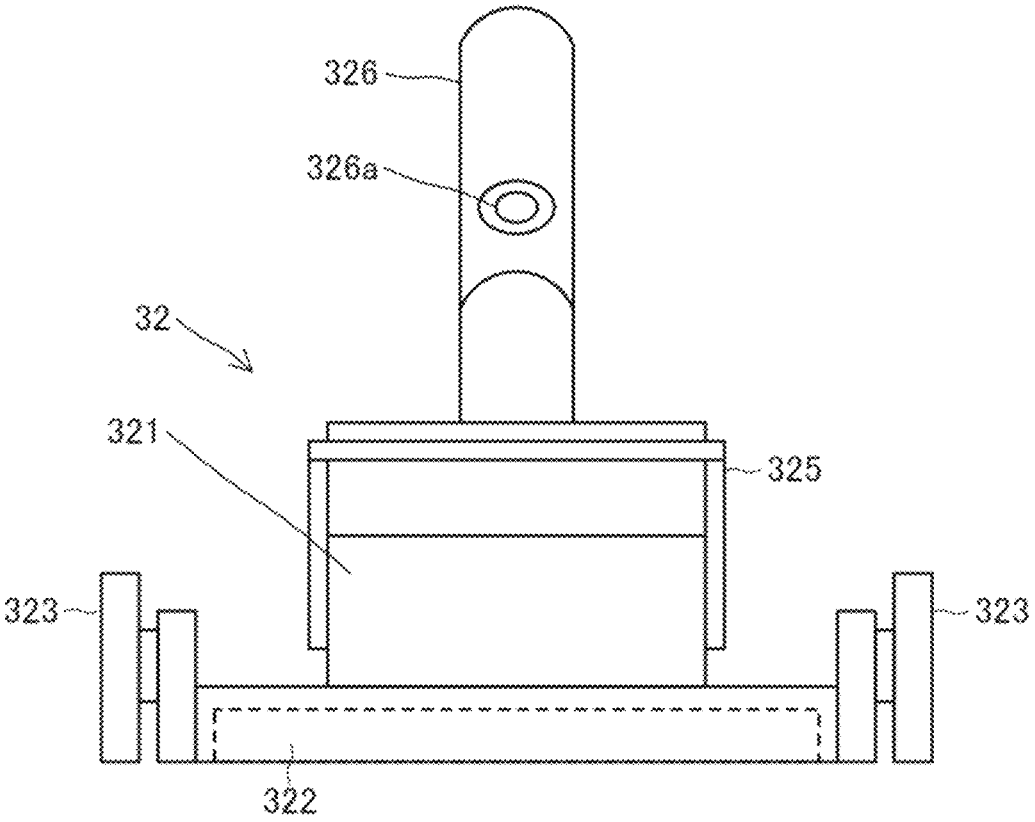
FIG. 7 illustrates an example configuration of the heating head illustrated in FIG. 5.
Figure 8:
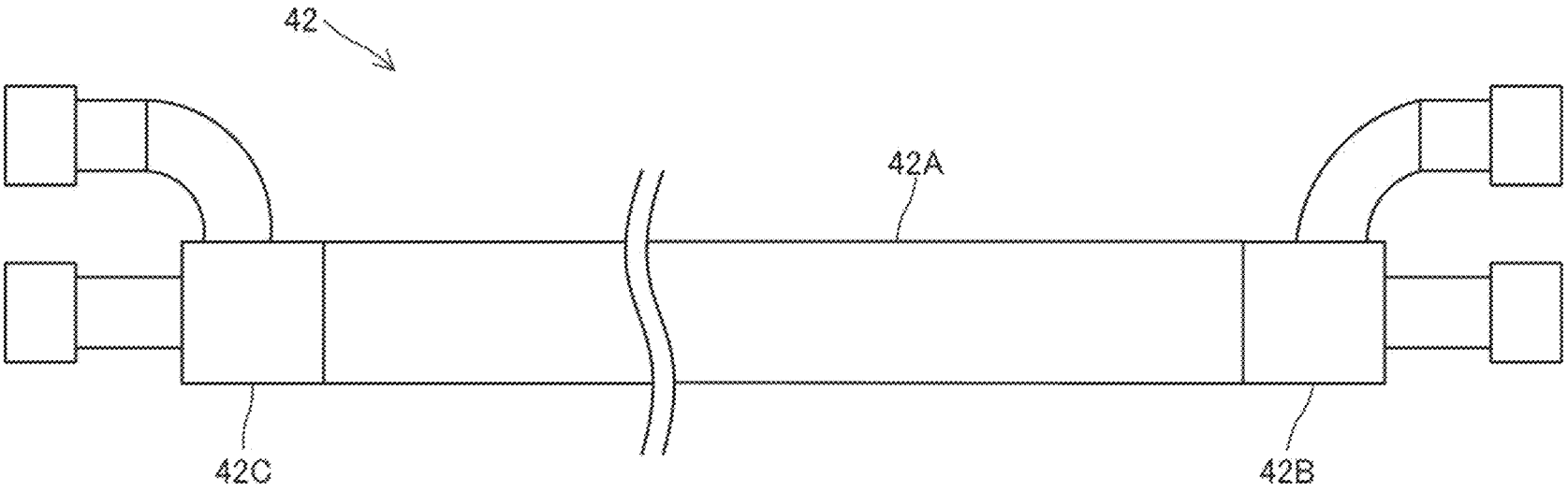
FIG. 8 illustrates an example configuration of a water-cooling coaxial cable connecting the transformer and the heating head illustrated in FIG. 5.
Figure 9:
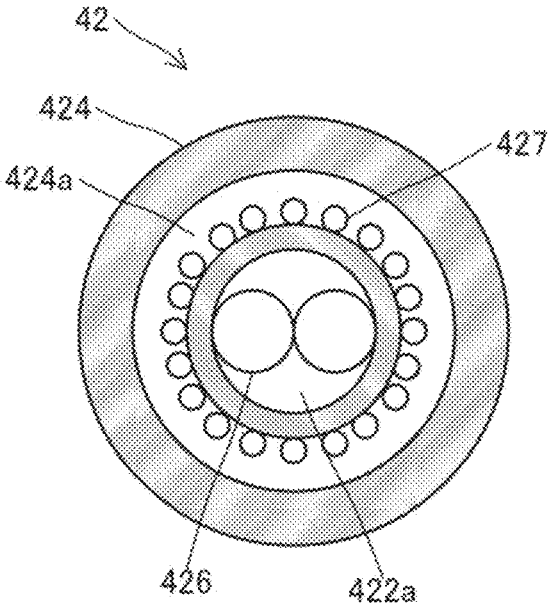
FIG. 9 is a cross-sectional view of an example of the water-cooling coaxial cable illustrated in FIG. 8.
Figure 10:
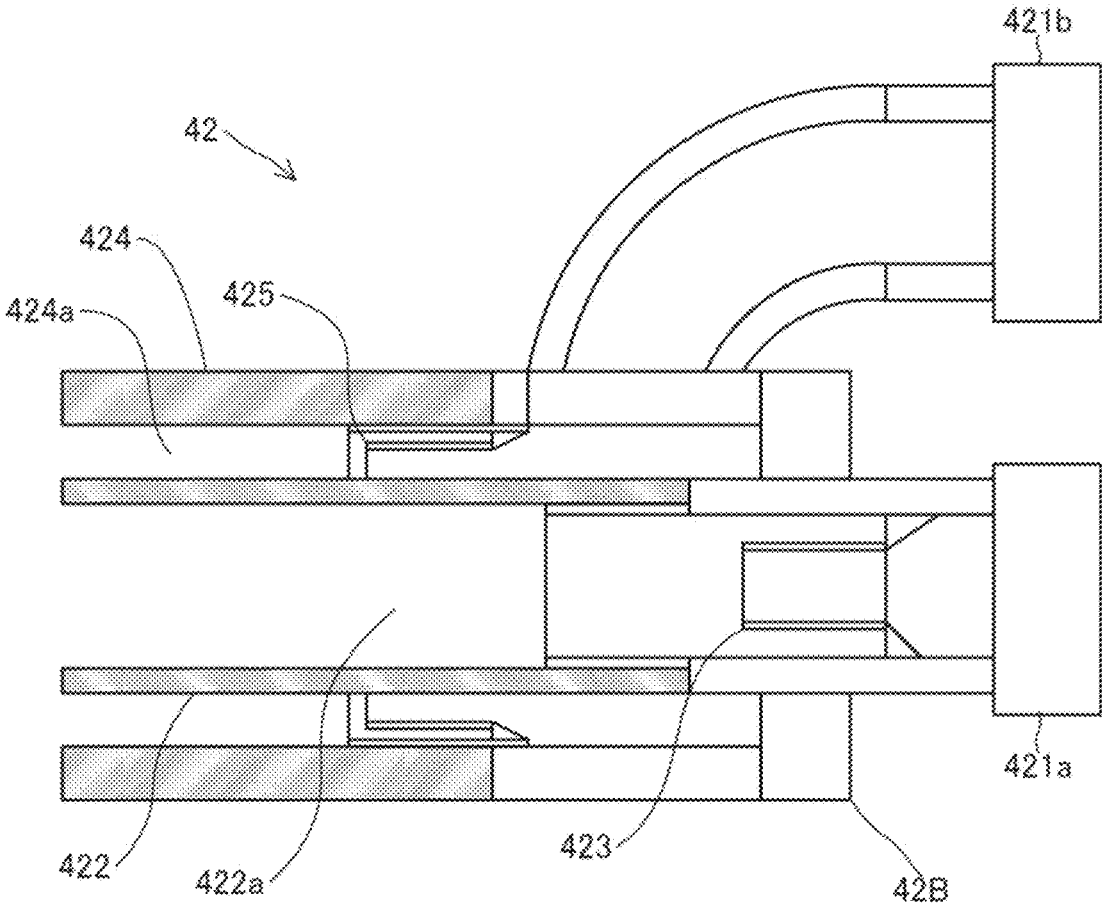
FIG. 10 is a cross-sectional view of an example of the water-cooling coaxial cable illustrated in FIG. 8.

A first embodiment of the present invention will now be described with reference to FIGS. 2 to 10. FIG. 2 illustrates the overall configuration of a heater for coating removal. FIGS. 3 and 4 illustrate an example configuration of a transformer 21 and a heating head 31 connected via a connector 41. FIGS. 5 and 6 illustrate an example configuration of the transformer 21 and a heating head 32 connected via a water-cooling coaxial cable 42. FIG. 7 illustrates an example configuration of the heating head 32 illustrated in FIG. 5. FIG. 8 illustrates an example configuration of the transformer 21 and the heating head 32 connected via the water-cooling coaxial cable 42 illustrated in FIG. 5. FIGS. 9 and 10 are cross-sectional views of an example configuration of the water-cooling coaxial cable 42.

This embodiment describes a heater for coating removal that is used for removing a coating film deposited on the surface of a metal member. As described below, the heater for coating removal according to this embodiment allows use of any one of multiple heating heads 3 having different sizes without replacement of a transformer. Through such a configuration, the heating head 3 to be used may be readily changed depending on, for example, the target area of coating removal.

With reference to FIG. 2, the heater for coating removal according to this embodiment includes a body 1, a transformer 2, and a heating head 3 (a portion of a heating unit). The heater for coating removal is used for removal of a coating film 51 from a metal member 50 by moving the heating head 3 over the metal member 50 coated with the coating film 51 and subjecting the metal member 50 to induction heating as indicated by reference sign H. The configurations of the components will now be described in detail.

The configuration of the body 1 will now be described with reference to FIG. 2. The body 1 includes a power source 11 (high-frequency power source) that outputs a high-frequency current and a water-cooling device 12 that circulates cooling water for cooling the heating coil of the heating head 3 and other components. The power source 11 and the water-cooling device 12 are mutually connected, and, for example, the water-cooling device 12 operates by receiving electrical power from the power source 11.

The power source 11 and the water-cooling device 12 are connected to the transformer 2. As described below, the high-frequency current outputted from the power source 11 is transformed at the transformer 12 and then sent to the heating head 3. The cooling water circulated by the water-cooling device 12 is sent to the heating head 3 through the transformer 2.

Note that the power source 11 and the water-cooling device 12 do not necessarily have to be integrated into a single unit.

The body 1, which includes the power source 11 and the water-cooling device 12, has a predetermined weight. Thus, when the heating head 3 is moved, the body 1 remains stationary at a predetermined position, i.e., is placed and held at the predetermined position.

The body 1 of the heater for coating removal according to this embodiment having the configuration described above can be connected to heating heads 3 having different configurations. Example configurations of the heating heads 3 that can be included in the heater for coating removal will be described below together with the transformer 2 with reference to FIGS. 3 to 9.

With reference to FIGS. 3 and 4, a transformer 21 and a heating head 31 that exemplifies the heating head 3 will now be described. When the heating head 31 is used, the transformer 21 and the heating head 31 are integrated into a single unit, as illustrated in FIG. 3. Thus, to move the heating head 31, the transformer 21 and the heating head 31 have to be moved together. Such a mode could be employed when the heating head 31 has a relatively large size.

With reference to FIG. 3, the transformer 21 includes a transformer body 211, a cooling-water pipe 212, a high-frequency cable 213, and a top face cover 214. The transformer body 211 is connected to the water-cooling device 12 via the cooling-water pipe 212 and to the power source 11 via the high-frequency cable 213. The end of the transformer body 211 opposite to the end connected to the cooling-water pipe 212 and the high-frequency cable 213 is detachably connected to the heating head 31 via a connector 41, such a connecting cable (for example, a water-cooling coaxial cable). For example, the connector 41 and the transformer body 211 are detachably fixed to each other by cap nuts or the like. By detachably fixing the connector 41 and the transformer body 211, the transformer body 211 and the heating head 31 are integrated into a single unit.

The transformer body 211 transforms the inputted high-frequency current and outputs the transformed current. The transformer body 211 is connected to the power source 11 via the high-frequency cable 213, as described above. The transformer body 211 is also connected to the heating head 31 via the connector 41. The high-frequency current outputted from the power source 11 is transformed at the transformer body 211 of the transformer 21 and sent to the heating head 31 via the connector 41.

The top face cover 214 prevents the operator of the heater for coating removal from being subjected to electrical shock and also functions as a handle of the transformer body 211. The top face cover 214 has, for example, a substantially rectangular planar shape and is connected to the transformer body 211, which is disposed adjacent to one of the faces of the top face cover 214, at predetermined positions.

The heating head 31 (integrated heating head, second heating head, second heating unit) will now be described.

The heating head 31 is connected to the transformer body 211 via the connector 41 and receives a transformed high-frequency current and cooling water from the transformer body 211.

With reference to FIGS. 3 and 4, the heating head 31 includes wheels 313 disposed on the sides of the head body 311 and rear wheels 314 disposed on the rear portion of the heating head 31 (adjacent to the transformer body 211). The heating head 31 can travel over the metal member 50 coated with the coating film 51 with the wheels 313 and the rear wheels 314. A handle support 315 is supported on the side faces of the head body 311 such that the handle support 315 is pivotable in the anterior-posterior direction. The handle support 315 is equipped with a rod-like handle 316. The operator of the coating removal can hold the handle 316 and move the heating head 31. The handle 316 is provided with a switch 316*a* for inputting an instruction of start/stop of heating by the heating head 31.

The head body 311 is connected to the transformer body 211 via the connector 41. A heating coil 312 is disposed near the inner bottom face of the head body 311 at a position above the metal member 50 coated with the coating film 51 when the heater for coating removal is placed on a surface.

The heating coil 312 (second heating coil) receives the high-frequency current fed to the head body 311 via the connector 41. The high-frequency current fed to the heating coil 312 enables the heating coil 312 to heat the metal member 50 through induction heating by the magnetic field generated by the high-frequency current. The heating of the metal member 50 can remove the coating film through lowering of the adhesive force of the coating film 51.

The heating coil 312 according to this embodiment is composed of a metal having low electrical resistance, such as copper, and wound into a shape of a hollow cylinder or pipe. The cooling water fed to the head body 311 through the connector 41 is circulated through the pipe-shaped heating coil 312.

The heating coil 312 has the shape described above and is, for example, an air core solenoid coil. The inductance of a typical solenoid coil can be expressed through the following equation.

$$L = \frac{k\mu SN^2}{l} \quad \text{[Equation 1]}$$

where L is an inductance value, k is the Nagaoka coefficient, μ is magnetic permeability, N is the number of turns of the coil, S is the cross-sectional area of the coil, and I is the length of the coil.

According to Equation 1, when the length of the coil is the same, the coil having the larger cross-sectional area or the larger number of turns has a larger inductance value.

The transformer 2 and the heating head 3 constitute, for example, a single unit integrating the transformer 21 and the heating head 31, as described above. Such a configuration is suitable for a heating head 31 having a relatively large size. In the case of removal of a coating film from small areas or parts, smooth coating removal is difficult with an integrated unit of the transformer 2 and the heating head 3 as described above because, for one reason, the integrated unit is heavy due to the additional weight of the transformer 2.

Thus, for removal of coating from small areas or parts, a heating head 32 could be used in place of the heating head 31. The transformer 21 and the heating heads 32, which is another example of the heating head 3, will now be described with reference to FIGS. 5 to 9.

As illustrated in FIGS. 5 and 6, the heating head 32 (cable-connected heating head, first heating head, portion of first heating unit) is detachably connected to the transformer 21 via the water-cooling coaxial cable 42 (cable, portion of first heating unit). When the heating head 32 is to be used, the transformer 21 (transformer body 211) is not integrated with the heating head 32.

Due to such a configuration, the transformer 21 does not have to be moved together with the heating head 32 when the heating head 32 is used. In other words, even when the heating head 32 is moved, the transformer 21 remains stationary at a predetermined position, i.e., is placed and held at the predetermined position. When the transformer 21 is to be moved, it may be disposed on a dolly to form a structure similar to a vacuum cleaner.

Details of the water-cooling coaxial cable 42 will be described below.

The heating head 32 is connected to the transformer body 211 via the water-cooling coaxial cable 42 and receives a transformed high-frequency current and cooling water from the transformer body 211.

The heating head 32 has the same configuration as that of the heating head 31, except for having a size different from that of the heating head 31 and being connected to the transformer body 221 via the water-cooling coaxial cable 42.

In specific, the heating head 32 includes a head body 321, a heating coil 322, wheels 323, rear wheels 324, a handle support 325, and a handle 326, as illustrated in FIGS. 6 and 7. These components are the same as the components of the heating head 31 (i.e., the head body 311, the heating coil 312, the wheels 313, the rear wheels 314, the handle support 315, and the handle 316), except for having a different size.

As described above, the heating head 32 and the heating head 31 have different sizes. In specific, the heating head 32 is smaller than the heating head 31.

Such a difference in size leads to a difference in the sizes of the components. In other words, the heating coil 322 is also smaller than the heating coil 312. As a result, the number of turns of the heating coil 322 is smaller than that of the heating coil 312. The cross-sectional area of the heating coil 322 is also smaller than that of the heating coil 312.

With reference to Equation 1 described above, it is presumed that the inductance of the heating coil 322 is lower than that of the heating coil 312 because the number of turns and the cross-sectional area of the heating coil 322 are smaller than those of the heating coil 312. In this way, the size difference in the heating coil 322 leads to a difference in inductance between the heating coil 322 and the heating coil 312. Thus, in this embodiment, the difference in inductance is adjusted through adjustment of the length of the water-cooling coaxial cable 42. In specific, the inductance of the water-cooling coaxial cable 42 increases in proportion to an increase in the length of the water-cooling coaxial cable 42. The length of the water-cooling coaxial cable is increased for smaller heating heads 3 (heating coils) such that the sum of the inductances of the components downstream of the transformer 21 falls within a predetermined range relative to the inductance of the heating head 31 directly attached to the transformer 21 (the inductance of the connector 41 may be taken into consideration). That is, one of the multiple heating units, including the heating coil 312, the heating coil 322, and the water-cooling coaxial cable 42, is selected, and the inductance value of the other heating units is adjusted to fall within a predetermined range relative to the inductance value of the selected heating unit. In specific, for example, the sum of the inductance value of the water-cooling coaxial cable 42 and the inductance value of the heating coil 322 is adjusted to fall within a predetermined range relative to the inductance value of the heating coil 312. In other words, the sum of the inductance value of the water-cooling coaxial cable 42 and the inductance value of the heating coil 322 is adjusted to fall within a predetermined range relative to the inductance value of the heating coil 312. Such adjustments achieve impedance matching between a configuration using the heating head 31 and a configuration using the heating head 32 (and the water-cooling coaxial cable 42), thereby enabling efficient transmission. As a result, the heating head 3 can be changed among multiple heating heads having different sizes, as needed, without changing the transformer 21.

When the inductance value of the heating coil 312 is 1.0, the sum of the inductance value of the heating coil 322 and the inductance value of the water-cooling coaxial cable 42 is adjusted to be, preferably, within the range of 0.6 to 1.3. The sum of the inductance value of the heating coil 322 and the inductance value of the water-cooling coaxial cable 42 is adjusted to be, more preferably, within the range of 0.9 to 1.3. Such adjustment of the inductance values enables even more efficient transmission.

The configuration of the water-cooling coaxial cable 42 will now be described with reference to FIGS. 8 to 10. One of the ends of the water-cooling coaxial cable 42 is connected to the transformer 21 and the other end is connected to the heating head 32, to send a high-frequency current and cooling water to the heating head 32.

In this embodiment, the water-cooling coaxial cable 42 consists of one water-cooling coaxial cable. In specific, with reference to FIG. 8, the water-cooling coaxial cable 42 includes a flexible tubular cable body 42A having a predetermined length and cable connection terminals 42B and 42C connected to the two ends of the cable body 42A. As described above, the length of the water-cooling coaxial cable 42 is adjusted in accordance with the size of the heating head 32 (dimensions of the heating coil) connected to the end of the water-cooling coaxial cable 42. The internal configuration of the water-cooling coaxial cable 42 will now be described with reference to FIGS. 9 and 10.

FIG. 10 is a longitudinal cross-sectional view of the cable connection terminal 42B and the cable body 42A near one end of the water-cooling coaxial cable 42. FIG. 9 is a cross-sectional view taken along a direction orthogonal to the longitudinal direction of the cable body 42A. In the cross-sectional views of FIGS. 9 and 10, the tubes of the cable body 42A composed of an insulating material are indicated by the hatched areas.

The cable body 42A consists of two layers of tubing. In specific, the cable body 42A includes a cylindrical outer tube 424 disposed on the outer side and an inner tube 422 passing through the inside of the outer tube 424. The outer tube 424 and the inner tube 422 are composed of insulating material, for example, the outer tube 424 being a silicone blade hose, and the inner tube 422 being a polyurethane tube.

With reference to FIG. 9, first conductors or inner conductors 426 are disposed inside the inner tube 422 or at the center of the cable body 42A. The inner conductors 426 are, for example, two litz wires and connected to an inner-conductor connection terminal 423 disposed at a first terminal 421*a* described below. A high-frequency current is fed to the inner conductors 426. The space between the inner tube 422 and the inner conductors 426 or the space around the inner conductors 426 defines a first water channel 422*a*. Water flowing in and out the first terminal 421*a* described below flows through the first water channel 422*a*.

Second conductors or outer conductors 427 are disposed on the outer side or circumference of the inner tube 422, as illustrated in FIG. 9. The outer conductors 427 are, for example, litz wires and connected to an outer-conductor connection terminal 425 disposed at a second terminal 421*b* described below. A high-frequency current is fed to the outer conductors 427. At this time, the outer conductors 427 is formed such that a current flows in a direction opposite to the direction of the flow of a current in the inner conductors 426 described above. The outer tube 424 is disposed on the outer side of the inner tube 422 and the outer conductors 427. The space between the inner tube 422 and the outer tube 424 or the space around the outer conductors 427 defines a second water channel 424*a*. Water flowing in and out the second terminal 421*b* described below flows through the second water channel 424*a*.

The cable connection terminal 42B, which is disposed at one end of the water-cooling coaxial cable 42, branches into the first terminal 421*a* and the second terminal 421*b*, which have cylindrical shapes. The terminals 421*a* and 421*b* are connected to the transformer 21. The first terminal 421*a* is coupled with the inner tube 422 to flow water through the first water channel 422*a* in the inner tube 422. The first terminal 421*a* is connected to the inner conductors 426 in the inner tube 422 and includes the inner-conductor connection terminal 423 for transmission of a high-frequency current. The second terminal 421*b* is coupled with the outer tube 424 to flow water through the second water channel 424*a* in the outer tube 424. The second terminal 421*b* is connected to the outer conductors 427 in the outer tube 424 and includes the outer-conductor connection terminal 425 for transmission of a high-frequency current.

The cable connection terminal 42C disposed at the other end of the water-cooling coaxial cable 42 has the same configuration as that of the terminal at the one end of the water-cooling coaxial cable 42 and is coupled with the heating head 32.

As described above, the heating head 32 is connected to the transformer 21 via the water-cooling coaxial cable 42 having a predetermined length. Through such a configuration, the sum of the inductance of the heating coil 322 and the inductance of the water-cooling coaxial cable 42 equals the inductance of the heating coil 312, even when the heating head 32 is smaller than the heating head 31. As a result, either the heating head 31 or the heating head 32 can be used without changing the transformer 21.

In this way, the heater for coating removal according to this embodiment includes the heating head 31 and the heating head 32. The sum of the inductance generated at the heating coil 322 of the heating head 32 and the inductance generated at the water-cooling coaxial cable 42 is adjusted to fall within a predetermined range relative to the inductance generated at the heating coil 312 of the heating head 31. Through such a configuration, the heating head 31 and the heating head 32 can be changed to suit the target area of coating removal, without changing the transformer 21. As a result, any one of the heating heads 3 can be used without excess time and effort.

Note that the number of the heating heads 3 of the heater for coating removal can be any number besides two. The heater for coating removal may include a plurality of heating heads 3. In such a case, the length of the water-cooling coaxial cable 42 is adjusted in accordance with the sizes of the heating heads 3.

In this embodiment, the heating head 32 and the transformer 21 are connected via the water-cooling coaxial cable 42. Alternatively, the heating head 32 and the transformer 21 may be connected via a cable having a predetermined length beside the water-cooling coaxial cable.

In this embodiment, the sum of the inductance value of the heating coil 322 and the inductance value of the water-cooling coaxial cable 42 is adjusted to fall within a predetermined range relative to the inductance value of the heating coil 312. However, the heating unit to be the reference may be any heating unit beside a heating unit without a cable like the heating coil 312 (heating head 31). For example, the inductance value of the heating coil 312 may be adjusted to fall within a predetermined range relative to the sum of the inductance value of the heating coil 322 and the inductance value of the water-cooling coaxial cable 42.

Although the present invention has been described based on the embodiments, the present invention is not limited to the embodiments described above. Various modifications understandable by one skilled in the art may be made to the configurations and details of the present invention within the scope of the invention.

REFERENCE NUMERALS

1 body
11 power source
12 water-cooling device
2, 21 transformer
211 transformer body
212 cooling-water pipe
213 high-frequency cable
214 upper cover
3, 31, 32 heating head
311, 321 head body
312, 322 heating coil
313, 323 wheel
314, 324 rear wheel
315, 325 handle support
316, 326 handle
316*a*, 326*a* switch
41 connector
42 water-cooling coaxial cable
42A cable body
42B, 42C cable connection terminal
421*a* first terminal
421*b* second terminal
422 inner tube
422*a* first water channel
423 inner-conductor connection terminal
424 outer tube
424*a* second water channel
425 outer-conductor connection terminal
426 inner conductor
427 outer conductor

The invention claimed is:

1. A portable induction heating device comprising:

a high-frequency power source;

a transformer receiving a high-frequency current outputted from the high-frequency power source and outputting a transformed current; and a plurality of heating units detachably connected to the transformer and receiving the transformed current to heat a metal member having surface coated with a coating film, so as to remove the coating film, wherein at least one heating unit is selected from the plurality of heating units and attached to the transformer, the at least one heating unit among the plurality of heating units further comprises: a cable having a conductor transmitting the transformed current, and a first heating head including a heating coil connected to an end of the cable and heating the metal member by the transformed current, so as to remove the coating film, a size of the first heating head of the at least one heating unit is smaller than a size of a second heating head of other heating units, and the first heating head and the second heating head are changeable while the transformer remains unchanged, the sum of a first inductance value of the heating coil of the first heating head and a second inductance value of the cable is adjusted to be within a predetermined range relative to a third inductance value of the second heating head, the first and second inductance values are adjusted through adjustment of a length of the cable, a length of the heating coil, a cross-sectional area of the heating coil, and a number of turns of the heating coil, wherein the length of the heating coil of the first heating head is smaller than the length of the heating coil of the second heating head, the number of turns of the heating coil of the first heating head is smaller than the number of turns of the heating coil of the second heating head, and the cross-sectional area of the heating coil of the first heating head is smaller than the cross-sectional area of the heating coil of the second heating head, wherein the cable connects the transformer and the heating coil of the cable-connected heating head, and the length of the cable is adjusted in accordance with the first inductance value of the heating coil of the first heating head such that the sum of the first inductance value of the heating coil of the first heating head and the second inductance value of the cable is within a predetermined range relative to the third inductance value of the second heating head.

2. The portable induction heating device according to claim 1, wherein the cable is a water-cooling coaxial cable having a water channel.

3. A portable induction heating device comprising:

a high-frequency power source;

a transformer receiving a high-frequency current outputted from the high-frequency power source and outputting a transformed current; and a plurality of heating units detachably connected to the transformer and receiving the transformed current to heat a metal member having surface coated with a coating film, so as to remove the coating film, wherein the plurality of heating units comprises:

a first heating unit comprising: a cable having a conductor transmitting the transformed current; a first heating head comprising a first heating coil connected to an end of the cable and heating the metal member by the transformed current, so as to remove the coating film; and a second heating unit comprising a second heating head comprising a second heating coil heating the metal member by the transformed current, so as to remove the coating film, a size of the first heating head is smaller than a size the second heating head, and the first heating head and the second heating head are changeable while the transformer remains unchanged, the sum of a first inductance value of the cable of the first heating unit and a second inductance value of the first heating coil is adjusted to be within a predetermined range relative to a third inductance value of the second heating coil, and the first and second inductance values are adjusted through adjustment of a length of the heating coil, a length of the cable, a cross-sectional area of the heating coil, and a number of turns of the heating coil, wherein the length of the heating coil of the first heating head is smaller than the length of the heating coil of the second heating head, the number of turns of the heating coil of the first heating head is smaller than the number of turns of the heating coil of the second heating head, and the cross-sectional area of the heating coil of the first heating head is smaller than the cross-sectional area of the heating coil of the second heating head, wherein the cable connects the transformer and the heating coil of the first heating head, and the length of the cable is adjusted in accordance with the first inductance value of the heating coil of the first heating head such that the sum of the first inductance value of the heating coil of the first heating head and the second inductance value of the cable is within a predetermined range relative to the third inductance value of the second heating head.

4. The portable induction heating device according to claim 3, wherein when the third inductance value of the second heating coil is 1.0H, the sum of the first inductance value of the cable of the first heating coil and the second inductance value of the first heating coil is adjusted to be within a range of 0.6H to 1.3H.

5. The portable induction heating device according to claim 3, wherein the cable is a water-cooling coaxial cable having a water channel.

* * * * *